US008627700B2

(12) United States Patent
Abe et al.

(10) Patent No.: US 8,627,700 B2
(45) Date of Patent: Jan. 14, 2014

(54) METHOD OF MANUFACTURING A WHEEL RIM FOR A VEHICLE

(75) Inventors: Kishiro Abe, Ayase (JP); Takamitsu Takano, Ayase (JP); Katsuki Kato, Atsugi (JP); Kenji Taguchi, Ayase (JP)

(73) Assignee: Topy Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/587,478

(22) Filed: Aug. 16, 2012

(65) Prior Publication Data

US 2012/0304723 A1 Dec. 6, 2012

Related U.S. Application Data

(63) Continuation of application No. PCT/JP2011/053201, filed on Feb. 16, 2011.

(30) Foreign Application Priority Data

Feb. 17, 2010 (JP) ..... 2010-031955

(51) Int. Cl.
*B21B 15/00* (2006.01)
*B21D 22/00* (2006.01)

(52) U.S. Cl.
USPC ..... 72/296; 72/256; 72/106; 72/260

(58) Field of Classification Search
USPC ..... 72/347–349, 105, 106, 256, 260, 295, 72/296, 361
See application file for complete search history.

(56) References Cited

U.S. PATENT DOCUMENTS

| | | | | |
|---|---|---|---|---|
| 3,258,833 A | | 7/1966 | Schuttler | |
| 3,438,111 A | * | 4/1969 | Wilcox | 72/347 |
| 4,346,581 A | * | 8/1982 | Ando | 72/347 |
| 4,408,379 A | | 10/1983 | Kusano | |
| 5,845,400 A | | 12/1998 | Takamoku | |

(Continued)

FOREIGN PATENT DOCUMENTS

| | | |
|---|---|---|
| JP | 56-131033 | 10/1981 |
| JP | 58-016751 | 1/1983 |

(Continued)

OTHER PUBLICATIONS

English Language Abstract of JP 2004-512693 published Apr. 30, 2004.

(Continued)

*Primary Examiner* — Dana Ross
*Assistant Examiner* — Pradeep C Battula
(74) *Attorney, Agent, or Firm* — DLA Piper LLP (US)

(57) ABSTRACT

A method of manufacturing a wheel rim for a vehicle includes an ironing step for ironing a tubular material to manufacture a tubular member having a non-constant thickness, using an ironing apparatus provided with a punch, a die whose side surface opposing the punch is a convex and concave surface, and a pressing member. At the ironing step, a flange portion of the tubular material is set at the die, then the pressing member is moved relative to the die thereby to squeeze the flange portion of the tubular material by the pressing member and the die, and then the punch is moved relative to the die to iron at least a portion of the tubular material except the flange portion of the tubular material to manufacture the tubular member having a non-constant thickness.

10 Claims, 11 Drawing Sheets

(56) References Cited

U.S. PATENT DOCUMENTS

| | | | | |
|---|---|---|---|---|
| 5,921,130 | A | 7/1999 | Yamada | |
| 6,505,492 | B2 * | 1/2003 | Jroski | 72/348 |
| 6,978,649 | B1 | 12/2005 | Alencar | |
| 7,171,838 | B2 | 2/2007 | Shiokawa | |
| 2004/0016124 | A1 | 1/2004 | Guimard | |

FOREIGN PATENT DOCUMENTS

| | | |
|---|---|---|
| JP | 61-042430 | 2/1986 |
| JP | 7-088583 | 4/1995 |
| JP | 07-155882 | 6/1995 |
| JP | 10-160376 | 6/1998 |
| JP | 10-166102 | 6/1998 |
| JP | 2000-288669 | 10/2000 |
| JP | 2004-512963 | 4/2004 |
| KR | 2000-0043810 | 7/2000 |

OTHER PUBLICATIONS

English Language Translation of JP 2004-512693 published Apr. 30, 2004.
English Language Abstract of JP 10-160376 published Jun. 19, 1998.
English Language Translation of JP 10-160376 published Jun. 19, 1998.
English Language Abstract of JP 56-131033 published Oct. 14, 1981.
International Search Report issued in PCT/JP2009/069529 mailed on Dec. 15, 2009.
International Preliminary Report on Patentability issued in PCT/JP2009/069529 mailed Jun. 16, 2011.
International Search Report issued in PCT/JP2011/053201 on Apr. 26, 2011.
English Translation of International Search Report issued in PCT/JP2011/053201 on Apr. 26, 2011.
International Preliminary Report on Patentability issued in PCT/JP2011/053201 on Jun. 12, 2012.
English Translation of Article 34 Amendments in PCT/JP2011/053201 on Apr. 26, 2011.
English Language Abstract of JP 2000-288669 published on Oct. 17, 2000.
English Language Translation of JP 2000-288669 published on Oct. 17, 2000.
English Language Abstract of JP 61-042430 published on Feb. 28, 1986.
English Language Translation of JP 7-088583 published on Apr. 4, 1995.
English Language Abstract of JP 7-088583 published on Apr. 4, 1985.
Korean Office Action issued in KR 2011-7003605 dated Sep. 24, 2012.
English Language Translation of Korean Office Action issued in KR 2011-7003605 dated Sep. 24, 2012.
English Language Abstract of KR 10-0432616 published Jul. 15, 2000.
Japanese Office Action issued in JP 2009-262425 on Dec. 11, 2012.
English Language Translation of Japanese Office Action issued in JP 2009-262425 on Dec. 11, 2012.
English Language Abstract of JP 07-155882 published on Jun. 20, 1995.
English Language Translation of JP 07-155882 published on Jun. 20, 1995.
English Language Abstract of JP 58-016751 published Jan. 31, 1983.
English Language Abstract of JP 10-166102 published Jun. 23, 1998.
English Language Translation of JP 10-166102 published Jun. 23, 1998.
Related U.S. Appl. No. 13/108,660.

* cited by examiner

METHOD OF MANUFACTURING A WHEEL RIM FOR A VEHICLE

CROSS REFERENCE TO RELATED APPLICATIONS

This is a continuation of International Application Serial No. PCT/JP2011/053201, filed on Feb. 16, 2011, which claims priority from Japanese Patent Application No. JP2010-031955, filed on Feb. 17, 2010, the disclosures of both of which are hereby incorporated by reference in their entirety.

TECHNICAL FIELD OF THE INVENTION

The present invention relates to a method of manufacturing a wheel rim for a vehicle and, more particularly, a method of manufacturing a wheel rim for a vehicle having a non-constant thickness from a tubular material.

BACKGROUND OF THE INVENTION

Patent Document 1 discloses one example of a vehicle wheel rim having a non-constant thickness from a plate material having a constant thickness. In the manufacturing method of the wheel rim having a non-constant thickness of Patent Document 1, a cylindrical hollow material having a constant thickness is manufactured from a flat plate material having a constant thickness, and then the cylindrical material is formed to a cylindrical hollow member having a non-constant thickness by flow-forming such as a flow-turning, spinning, etc. The cylindrical member is roll-formed to a wheel rim configuration so that the vehicle wheel rim having a non-constant thickness is manufactured.

However, there are the following problems with the manufacturing method of the vehicle wheel rim having a non-constant thickness using flow-forming:

(i) The equipment used in the flow-forming may be expensive.

In flow-forming, since a roll for pressing the tubular material to a mandrel may be moved in two directions, an axial direction of the material and a thickness direction of the material, the flow-forming equipment may be expensive multiple times as compared with an ironing apparatus where a punch may be moved in only one direction.

(ii) Productivity of the flow-forming may be low.

The productivity of flow-forming may be about one third of that of forming using an ironing apparatus. If a rim manufacturing line is diverged to three subsidiary lines and each of the three subsidiary lines is provided with flow-forming equipment, the problem of productivity will be solved. However, since three sets of flow-forming equipment must be provided, the equipment cost and the amount of space for equipment placement are three times of those of a single set of flow-forming equipment.

(iii) Pushing flaws made by the flow-forming roll may remain at a surface of the material, and the appearance quality decreases.

RELATED ART DOCUMENT

Patent Document

Patent Document 1: Patent Publication JP 2004-512963

BRIEF SUMMARY

Object of the Invention

An object of the invention is to provide a method of manufacturing a wheel rim for a vehicle which can achieve at least one of (i) decreasing an equipment cost, (ii) improving a productivity and (iii) improving an appearance quality.

Means for Solving the Problems

The present invention capable of achieving the above object is as follows:

(1) A method of manufacturing a wheel rim for a vehicle comprising:

ironing a tubular material to a tubular member having a non-constant thickness using an ironing apparatus which has a punch, a die having a convex and concave surface opposing the punch and a pressing member, wherein the ironing comprises:

setting the tubular material on the die at a flange portion of the tubular material which is formed by bending the tubular material at a bent portion located at an axial end portion of the tubular material in a direction crossing an axial direction of the tubular material and is formed on a tip side of the bent portion;

then moving the pressing member relative to the die thereby squeezing the flange portion of the tubular material between the pressing member and the die; and then moving the punch relative to the die thereby ironing at least a portion of the tubular material except the flange portion of the tubular material to manufacture the tubular member having a non-constant thickness, and wherein when the tubular member is formed to a configuration of a wheel rim for a vehicle after the ironing at least a portion of the flange portion of the tubular material is formed to one of the flange portions of the rim of the wheel rim for a vehicle.

(2) A method of manufacturing a wheel rim for a vehicle according to item (1) above, wherein the flange portion of the tubular material has one or more axially intermediate bent portions.

(3) A method of manufacturing a wheel rim for a vehicle according to item (2) above, wherein a bending direction of at least one of the one or more axially intermediate bent portions and a bending direction of the bent portion are opposite to each other.

(4) A method of manufacturing a wheel rim for a vehicle according to item (2) or (3) above, wherein the axially intermediate bent portions are formed before the ironing and/or at the squeezing of the ironing.

(5) A method of manufacturing a wheel rim for a vehicle according to item (1) above, wherein at the ironing, the tubular material is received and pushed by an ejecting plate at an end of the tubular material opposite the flange portion of the tubular material.

(6) A method of manufacturing a wheel rim for a vehicle according to item (1) above, wherein the convex and concave surface is formed by providing at least one convex portion making a space between the die and the punch narrower than a thickness of the tubular material, at the die in an axial direction of the die along the side surface of the die opposing the punch.

(7) A method of manufacturing a tubular member according to item (1) above, wherein the convex and concave surface is formed by providing at least one convex portion making a space between the die and the punch narrower than a thickness of the tubular material, at the die in a circumferential direction of the die along the side surface of the die opposing the punch.

(8) A method of manufacturing a wheel rim for a vehicle according to item (1) above, further comprising roll-forming the tubular member having a non-constant thickness to a vehicle wheel rim configuration after the ironing.

Technical Advantages

According to the method of manufacturing a wheel rim for a vehicle according to item (1) above, since the tubular material is formed into the tubular member having a non-constant thickness by ironing, an equipment and a step of the conventional flow-forming may be unnecessary. As a result, the above-described problems (i), (ii) and (iii) existing in the flow-forming may be solved as the following ways (i), (ii) and (iii), respectively:

(i) Since the conventional flow-forming equipment may be replaced by the die and punch for ironing and the ironing apparatus in the present invention, and the combined cost of the die and punch for ironing and the ironing apparatus may be lower than that of the flow-forming equipment, the equipment cost may be decreased.

(ii) Since in the step of making the thickness of the material non-constant, the flow-forming may be replaced by ironing performed using the ironing apparatus in the present invention, a time period for making the thickness of the tubular material non-constant may be decreased to about one third of the time period required in the flow-forming, and the productivity may be improved. When a step of making a thickness of a cylindrical hollow material non-constant is provided to one rim manufacturing line, three sets of flow-forming equipment may be necessary to be provided in the conventional line. However, since the three sets of flow-forming equipment can be replaced by a single ironing apparatus according to the present invention, the problems relating to the costs and the space for placing equipment may be solved.

(iii) Since flow-forming may be replaced by ironing conducted using the punch and the die, any pushing flaw due to the flow-forming roll may not remain at the surface of the tubular member, and an appearance quality may be improved.

Further, since at the ironing, after squeezing the flange portion of the tubular material by the pressing member and the die, at least a portion of the tubular material except the flange portion of the tubular material is ironed, the tubular material may be suppressed from being drawn into the die by the punch and moved relative to the die. As a result, forming with a high accuracy may be possible.

According to the method of manufacturing a wheel rim for a vehicle according to item (2) above, since the flange portion of the tubular material has one or more axially intermediate bent portions, even if the bending angles of the bent portion and the axially intermediate bent portions are small, the tubular material may be more resistant to being drawn into the die by the punch and moved relative to the die than in a case where the flange portion of the tubular material does not have axially intermediate bent portions. Further, when the bending angles are small, forming at succeeding steps may be easy.

According to the method of manufacturing a wheel rim for a vehicle according to item (3) above, since a bending direction of at least one of the one or more axially intermediate bent portions and a bending direction of the bent portion are opposite to each other, a portion of the flange portion of the tubular material located on a tip side of the axially intermediate bent portion whose bending direction is opposite to the bending direction of the bent portion may engage with the pressing member, whereby the tubular material may be more resistant to being drawn into the die by the punch and moved relative to the die during ironing, differently from a case where a bending direction of each of the one or more axially intermediate bent portions and a bending direction of the bent portion are the same.

According to the method of manufacturing a wheel rim for a vehicle according to item (4) above, since the one or more axially intermediate bent portions are formed before the ironing and/or at the squeezing of the ironing by bending one or more axially intermediate portions of the flange portion of the tubular material, the tubular material may be more resistant to being drawn into the die by the punch and moved relative to the die than a case where the axially intermediate bent portions are not formed at the flange portion of the tubular material.

According to the method of manufacturing a wheel rim for a vehicle according to item (5) above, since at the ironing, the tubular material is received and pushed by an ejecting plate at an end (an axially opposite end) of the tubular material opposite the flange portion of the tubular material, the tubular material may be more resistant to being drawn into the die by the punch and moved relative to the die.

According to the method of manufacturing a wheel rim for a vehicle according to item (6) above, since the convex and concave surface is formed by providing at least one convex portion making a space between the die and the punch narrower than a thickness of the tubular material, at the die in an axial direction of the die along the side surface of the die opposing the punch, a tubular member having a thickness that changes along the axial direction may be manufactured.

According to the method of manufacturing a wheel rim for a vehicle according to item (7) above, since the convex and concave surface is formed by providing at least one convex portion making a space between the die and the punch narrower than a thickness of the tubular material, at the die in a circumferential direction of the die along the side surface of the die opposing the punch, a tubular member having a thickness that changes along the circumferential direction may be manufactured.

According to the method of item (8) above, since the method has a step of roll-forming the tubular member having a non-constant thickness to form a vehicle wheel rim configuration after the ironing step, it is possible to manufacture a vehicle wheel rim which has a non-constant thickness and is light.

BRIEF DESCRIPTION OF THE DRAWINGS

FIG. 1 is also applicable to a second embodiment of the present invention if a relationship of a die and a punch is changed and a relationship of an ejecting plate and a pressing member is changed.

FIG. 2 is also applicable to the second embodiment of the present invention.

FIG. 3 is also applicable to the second embodiment of the present invention.

FIG. 4 is also applicable to the second embodiment of the present invention.

FIG. 5 is also applicable to the second embodiment of the present invention if a relationship of the die and the punch is reversed and a relationship of the ejecting plate and the pressing member is reversed.

FIG. 6 is also applicable to the second embodiment of the present invention if a relationship of the die and the punch is reversed and a relationship of the ejecting plate and the pressing member is reversed.

FIG. 8 is also applicable to the second embodiment of the present invention if a relationship of the die and the punch is reversed and a relationship of the ejecting plate and the pressing member is reversed.

FIG. 9 is also applicable to the second embodiment of the present invention if a relationship of the die and the punch is reversed and a relationship of the ejecting plate and the pressing member is reversed.

DETAILED DESCRIPTION

A method of manufacturing a wheel rim for a vehicle according to the present invention will be explained with reference to the drawings.

Figure 1:
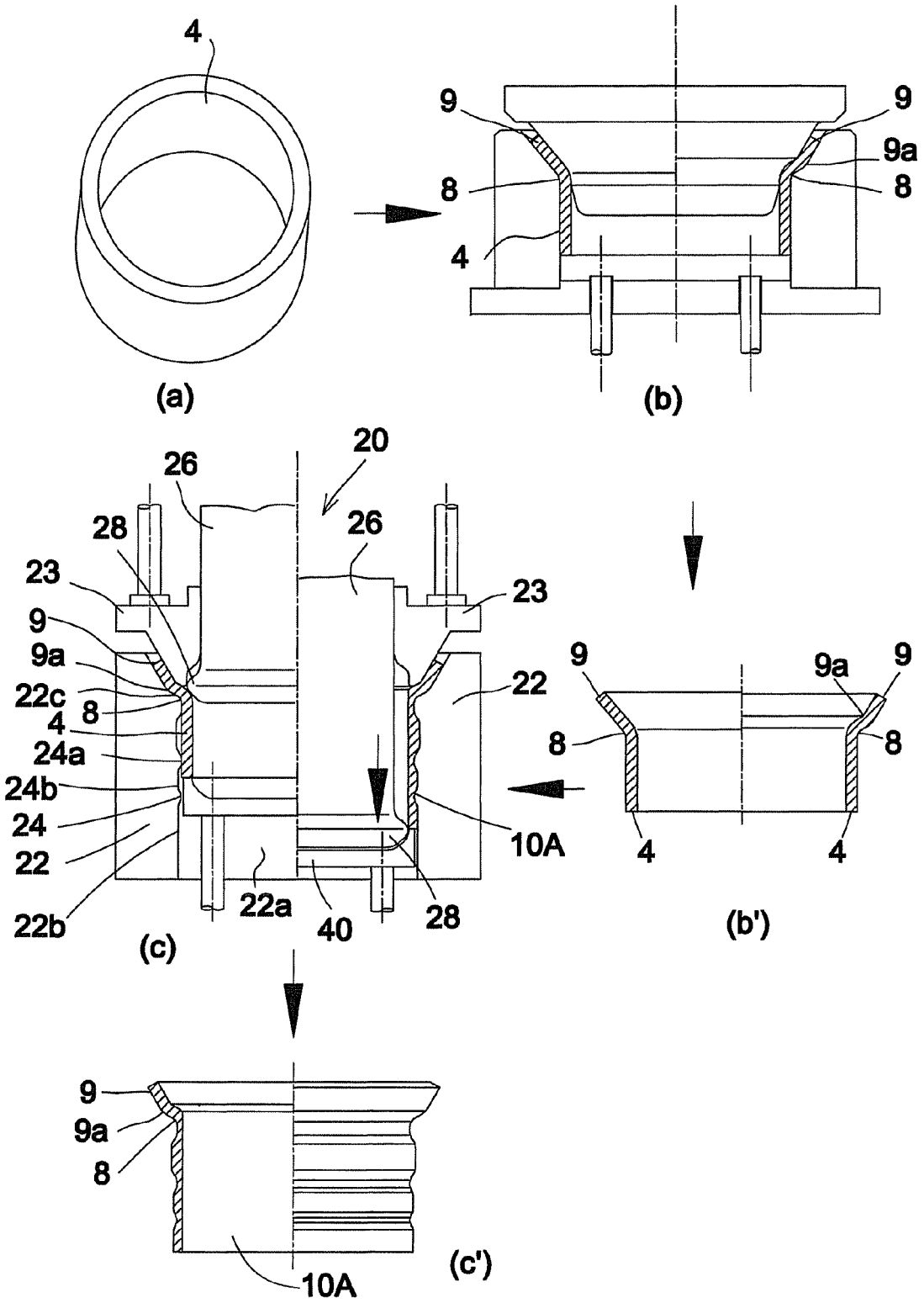
FIG. 1 is a process diagram illustrating a flange portion forming step and a ironing step, of a method of manufacturing a wheel rim for a vehicle according to a first embodiment of the present invention, where (a) illustrates a tubular material, (b) illustrates a flange portion forming step, a left half of (b) illustrating a case where forming only a flange portion of the tubular material is conducted, and a right half of (b) illustrating a case where both forming a flange portion of the tubular material and forming an axially intermediate bent portion are conducted, (b') illustrates a tubular material after the flange portion forming step, a left half of (b') illustrating a case where forming only a flange portion of the tubular material is conducted, and a right half of (b') illustrating a case where both forming a flange portion of the tubular material and forming an axially intermediate bent portion are conducted at the flange forming step, (c) illustrates an ironing step, a left half of (c) illustrating a state before ironing where the flange portion of the tubular material is squeezed between a pressing member and a die, and a right half of (c) illustrating a state after ironing, and (c') illustrates a tubular member having a non-constant thickness after ironing, a left half of (c') is a cross-sectional view of the tubular member, and a right half of (c') is a front view of the tubular member.
Figure 2:
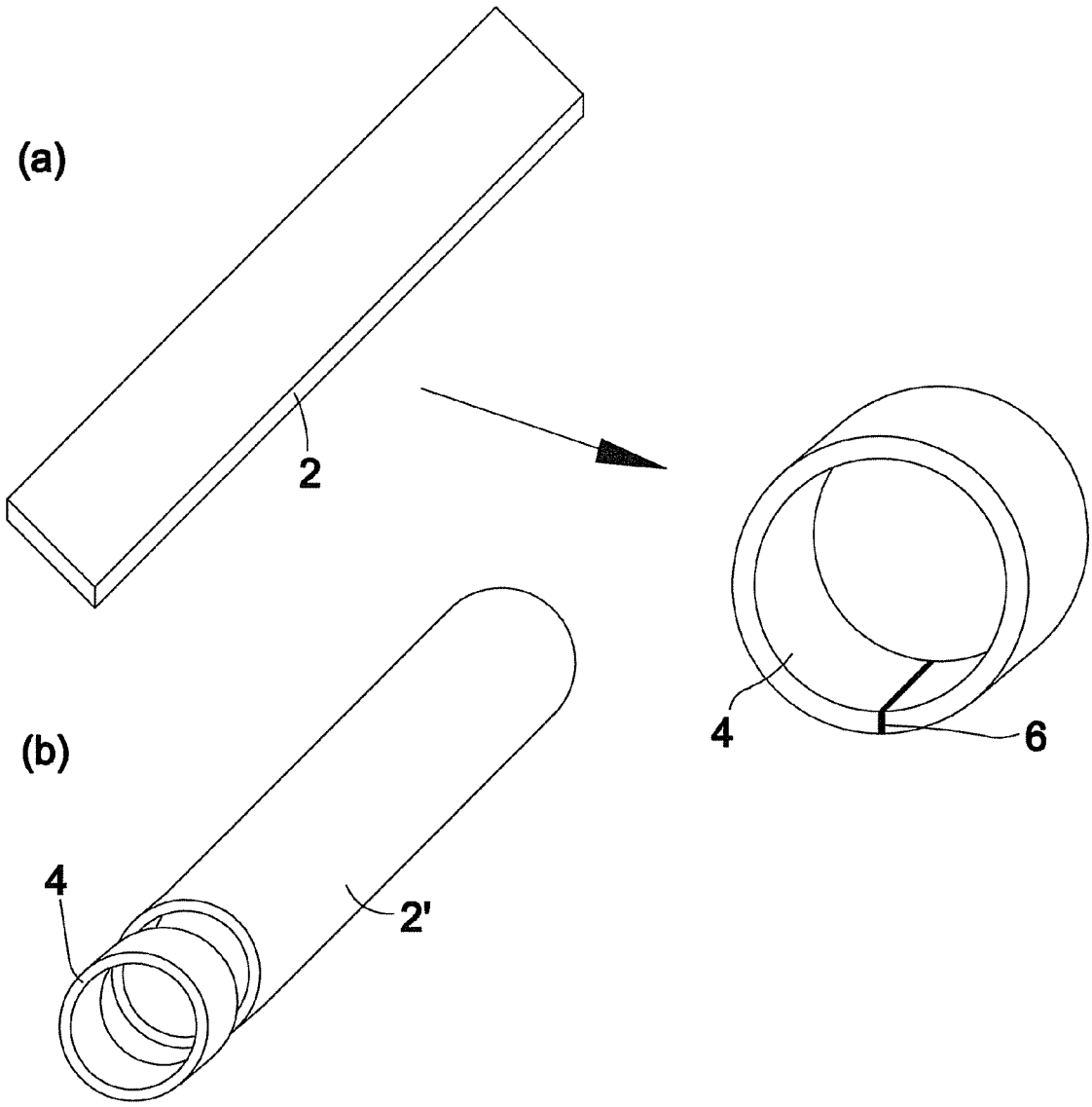
FIG. 2 is a process diagram illustrating a tubular material manufacturing step which is conducted before the flange portion forming step, of the method of manufacturing a wheel rim for a vehicle according to the first embodiment of the present invention, where (a) illustrates a step of rounding a plate material having a constant thickness to form a rounded material and then welding opposite ends of the rounded material to manufacture the tubular material, and (b) illustrates a step of cutting the pipe-like material to a predetermined length to manufacture the tubular material.
Figure 3:
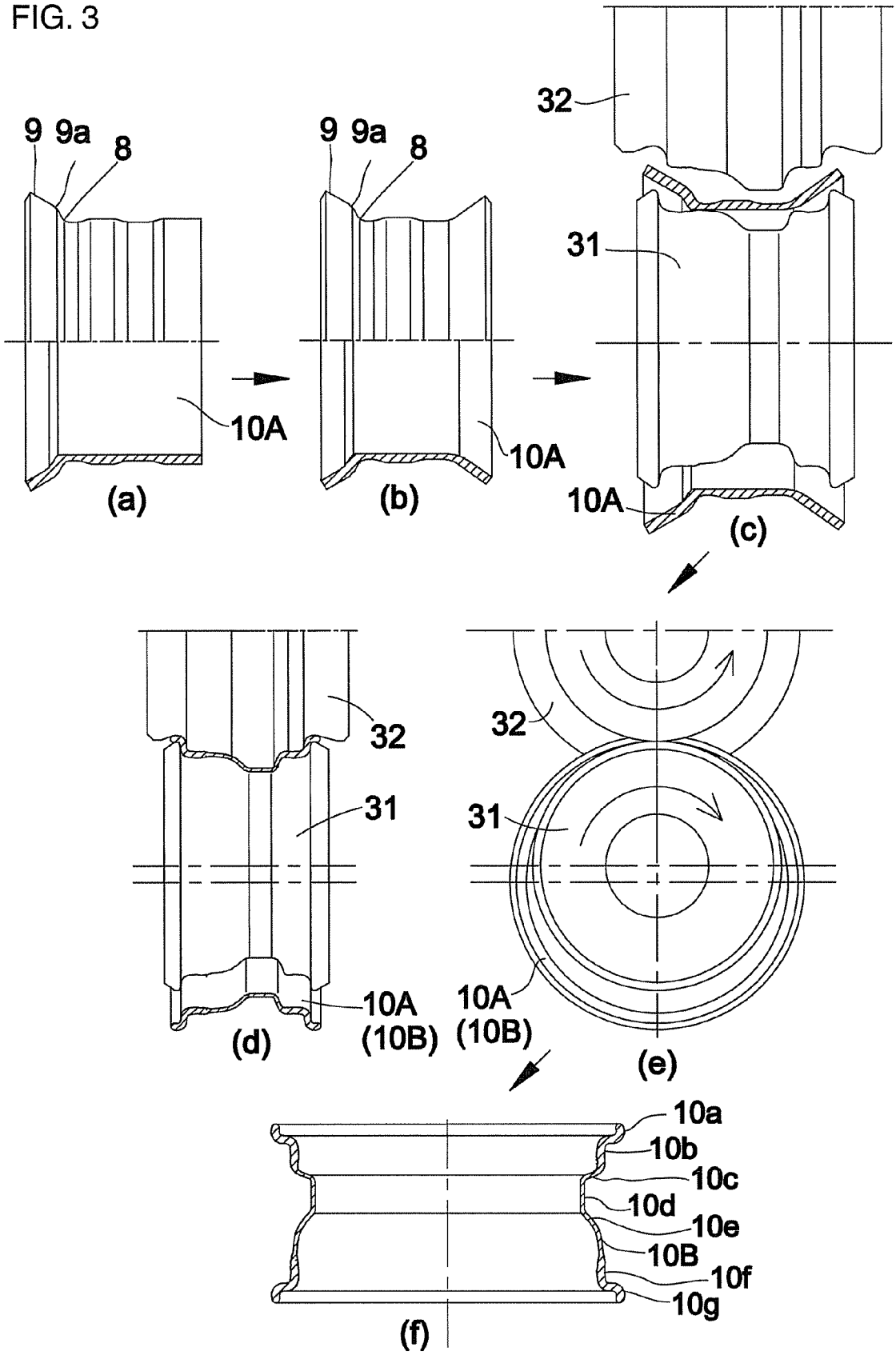
FIG. 3 is a process diagram illustrating a flaring step and a roll-forming step, of the method of manufacturing a wheel rim for a vehicle according to the first embodiment of the present invention, where (a) illustrates a tubular member having a non-constant thickness before flaring, an upper half of (a) being a side view of the tubular member and a lower half of (a) being a cross-sectional view of the tubular member, (b) illustrates a tubular member having a non-constant thickness after flaring, an upper half of (b) being a side view of the tubular member and a lower half of (b) being a cross-sectional view of the tubular member, (c) is a side view of an upper roll and a lower roll between which a wall of the tubular member having a non-constant thickness is disposed, where the tubular member is shown in cross section (and an upper half of the upper roll is not shown), (d) is a side view of the upper roll and the lower roll between which the wall of the tubular member having a non-constant thickness is roll-formed, where the tubular member is shown in cross section (and an upper half of the upper roll is not shown), (e) is a front view of the upper roll and the lower roll between which the wall of the tubular member having a non-constant thickness is roll-foimed, (where an upper half of the upper roll is not shown) and (f) is a cross-sectional view of the wheel rim for a wheel after roll-forming.
Figure 4:
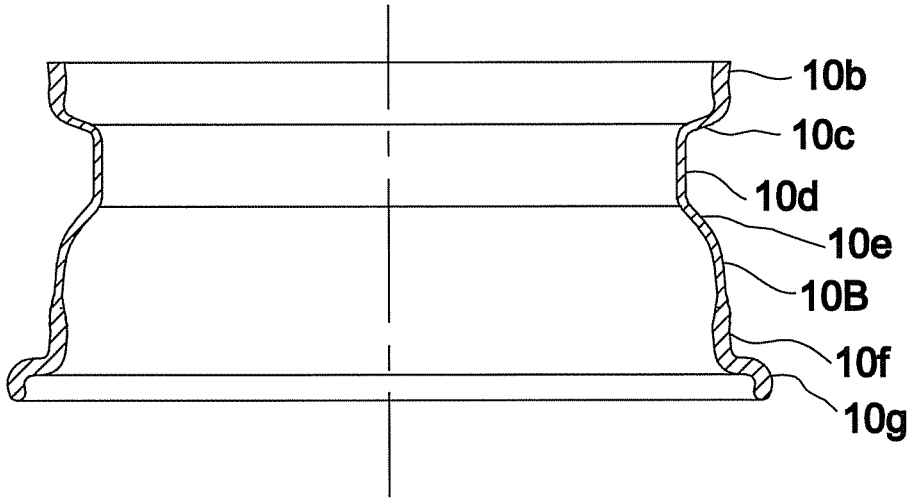
FIG. 4 is a cross-sectional view of a wheel rim for a vehicle in a case where a wheel rim made by the method of manufacturing a wheel rim for a vehicle according to the first embodiment of the present invention has only one rim flange portion of the rim.
Figure 9:
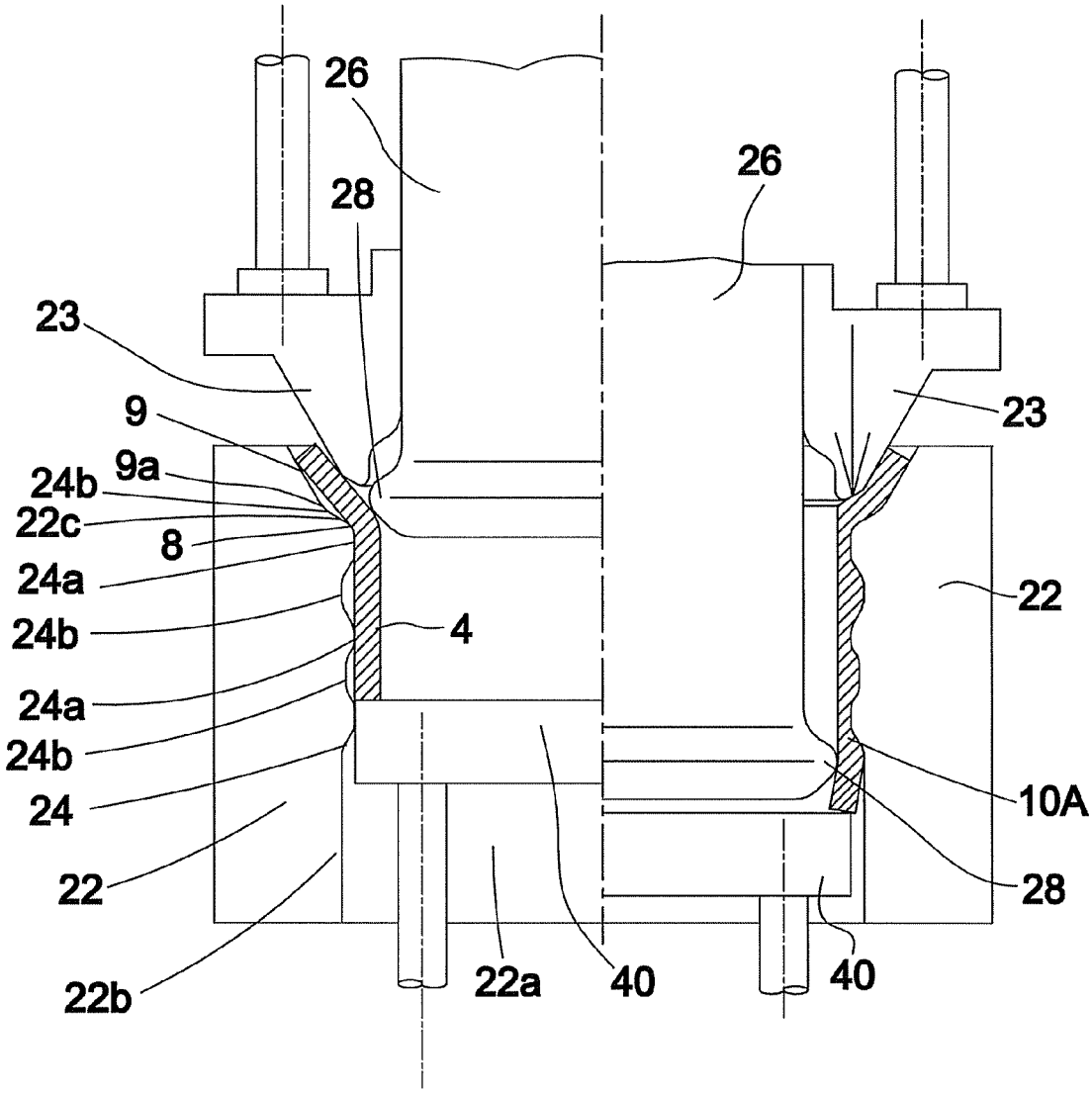
FIG. 9 is an enlarged view of only a tubular material and its vicinity, a part of which is shown in cross section, in the method of manufacturing a wheel rim for a vehicle according to the first embodiment of the present invention, in a case where an end portion of the tubular material opposite the flange portion of the tubular material is not ironed, because a punch stops at an intermediate position, a left half of FIG. 9 illustrating a state before ironing and a right half of FIG. 9 illustrating a state after ironing.
Figure 10:
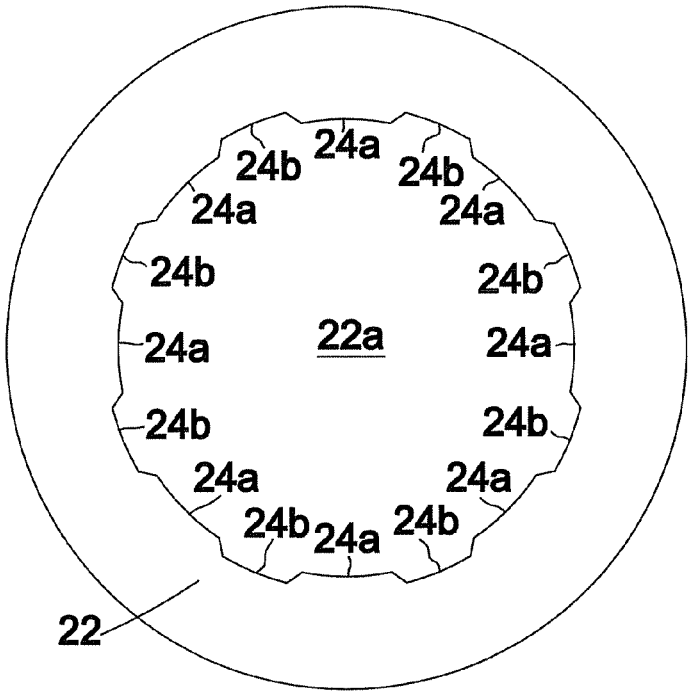
FIG. 10 is a cross-sectional view of a die (outer die) only, in a case where a protrusion for making a space between a punch and the die narrow in a circumferential direction is provided at the die, of the method of manufacturing a wheel rim for a vehicle according to the first embodiment of the present invention.
Figure 11:
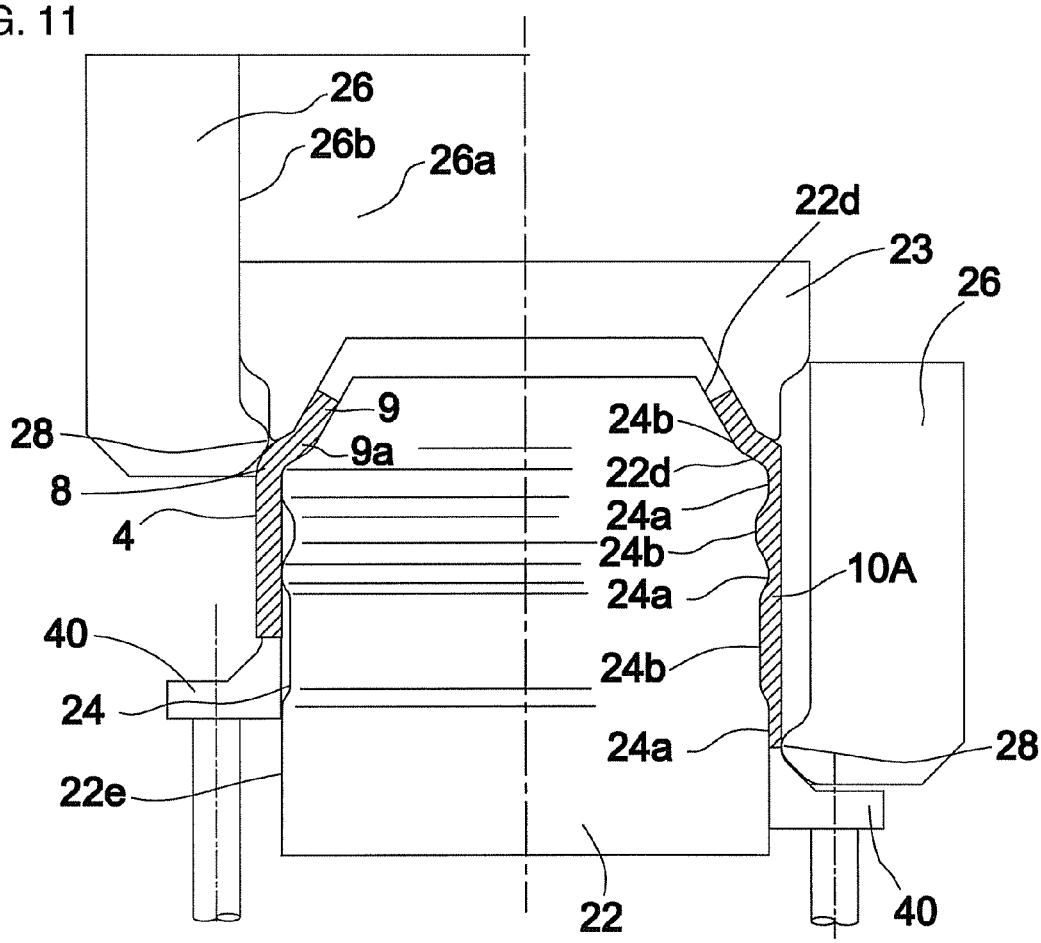
FIG. 11 is an enlarged view of only a tubular material and its vicinity, a part of which is shown in cross section, in the method of manufacturing a wheel rim for a vehicle according to the second embodiment of the present invention, a left half of FIG. 11 illustrating a state before ironing and a right half of FIG. 11 illustrating a state after ironing.
Figure 12:
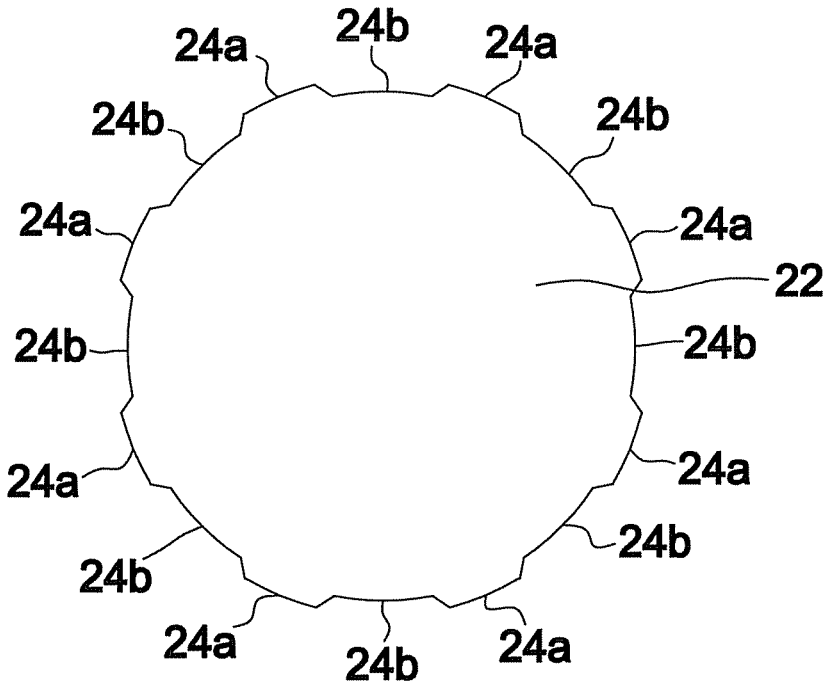
FIG. 12 is a cross-sectional view of a die (inner die) only, in a case where a protrusion for making a space between a punch and the die narrow in a circumferential direction is provided at the die, of the method of manufacturing a wheel rim for a vehicle according to the second embodiment of the present invention.

FIGS. 1-10 are applicable to a first embodiment of the present invention, and FIGS. 11 and 12 are applicable to a second embodiment of the present invention. FIGS. 1, 5, 6, 8 and 9 are applicable to the second embodiment of the present invention if a relationship of a die, a punch, an ejecting plate and a pressing member is changed, and FIGS. 2-4 are also applicable to the second embodiment of the present invention.

Portions common to all embodiments of the present invention are denoted with the same reference numerals throughout all embodiments of the present invention.

First, portions common to the all embodiments of the present invention will be explained.

As illustrated in FIGS. 1-3, a method of manufacturing a wheel rim 10B for a vehicle according to the present invention is a method of manufacturing the wheel rim 10B for a vehicle having a non-constant thickness from a tubular material 4. The tubular material 4 may be made from metal, and the metal may be, for example, steel, non-ferrous metal (including aluminum, magnesium, titanium and alloys thereof), etc. The wheel rim 10B for a vehicle having a non-constant thickness may be a member 10B having a wall curved in a direction perpendicular to an axis of a tubular member 10A by roll-forming a tubular member 10A with a wall having an inner surface and an outer surface one of which is a convex and concave surface and the other of which is a straight surface extending parallel to the axis of the tubular member. The tubular member 10A having a non-constant thickness may have an inner or outer surface portion extending parallel to the axis of the tubular member except a flange portion of the tubular material 9 after ironing. The tubular member 10B may be, for example, a vehicle wheel rim for use in a car, a truck, a bus or an industrial vehicle.

As illustrated in FIG. 1, the method of manufacturing the wheel rim 10B for a vehicle may include:

(a) a flange portion forming step for bending an axial end portion of the tubular material 4 having a constant thickness in a direction crossing an axial direction of the tubular material 4, thereby forming in the tubular material 4 a bent portion 8 and a flange portion of the tubular material 9 on an end side of the bent portion 8; and (b) an ironing step for manufacturing the tubular member 10A having a non-constant thickness using an ironing apparatus 20 including a punch 26, a die 22 having a convex and concave side surface 24 opposing the punch 26, and a pressing member 23.

Step (b) above may include steps of: causing the tubular material 4 to axially engage the die 22 at the flange portion of the tubular material 9; then moving the pressing member 23 relative to the die 22 thereby squeezing the flange portion of the tubular material 9 between the pressing member 23 and the die 22; and then moving the punch 26 relative to the die 22 thereby ironing at least a portion of the tubular material 4 except the flange portion of the tubular material 9 and manufacturing the tubular member 10A.

In (c) of FIG. 1, a left half illustrates a state where the flange portion of the tubular material 9 before ironing is squeezed between the pressing member 23 and the die 22, and a right half illustrates a state after the punch 26 has been moved relative to the die 22 and ironing the tubular material 4 has occurred. The tubular material 4 has been formed as the tubular member 10A having a non-constant thickness. A length of the flange portion of the tubular material may be preferably 6.5-17 times and more preferably 7-13 times the thickness of the tubular material 4.

There is no particular limitation to the size (i.e., an axial length and an outer diameter) of the tubular material 4. However, to be used on a variety of vehicles (i.e., on a car or a truck) the tubular material 4 used to form on wheel rims may have an axial length of 76 mm-265 mm or 150 mm-230 mm. Further, an outer diameter of the tubular material 4 may be 177 mm-600 mm, or may be 280 mm-580 mm.

When the tubular material 4 includes the flange portion of the tubular material 9 and can engage the die 22 such as a case where the tubular material 4 is a cast member, the flange portion forming step may not be required.

Before the forming of the flange portion of the tubular material 9, as illustrated in FIG. 2, the method of manufacturing a wheel rim for a vehicle may include a tubular material manufacturing step for manufacturing the tubular material 4 having a constant thickness from a flat plate material 2 having a constant thickness. In the tubular material manufacturing step, as illustrated in (a) of FIG. 2, the flat plate material (rectangular material) 2 may be manufactured by drawing out a plate having a constant thickness straight from a coil of the plate and cutting the drawn-out straight plate at an interval of a predetermined length thereby successively manufacturing a plurality of flat plate materials. Then, the flat plate material 2 may be bent in a curve and opposite ends of the rounded material may be welded to each other by flush butt welding, butt welding, or arc welding, etc., and then a burr of the welded portion 6 is trimmed whereby a tubular material 4 having a constant thickness is manufactured.

In the tubular material manufacturing step, as illustrated in (b) of FIG. 2, the tubular material 4 having a constant thickness may be manufactured by cutting a pipe-like material 2' at an interval of a predetermined length.

It may be conceived to burr (pierce-burr) a flat plate material to form a burred protrusion and to use the burred protrusion as a tubular material 4. However, if a hole caused in the flat plate material during the burring is enlarged in diameter to an extent that the burred protrusion can be used as the tubular material 4 for a wheel rim (for a car or a truck), a crack may be generated in the burred protrusion. Therefore, such a burred protrusion accompanied by a crack cannot be used as the tubular material 4.

In a case where a flange portion of the tubular material 9 is formed in the tubular material 4 during or after the flange portion forming step as illustrated in (b) of FIG. 1, a thickness of the flange portion of the tubular material 9 becomes thinner than a thickness of the tubular material 4 before forming the flange portion of the tubular material 9.

The thickness of the tubular material 4 may be 2.0 mm-8.0 mm, or 2.3 mm-6.0 mm. The thickness of the tubular material 4 may not be limited to the range and can be selected freely.

In the flange portion forming step, the flange portion of the tubular material 9 may be a bent portion (e.g., a curved portion), bent (e.g., curved) at an angle smaller than 90 degrees from an axial direction of the tubular material 4. At least a portion of the flange portion of the tubular material 9 may extend in a direction crossing the axial direction of the tubular material 4. The flange portion of the tubular material 9 operates to engage the die 22 and to position the tubular material 4 relative to the die 22 in the axial direction of the tubular material at the ironing step and contributes to prevent the tubular material 4 from being dislocated relative to the die 22 in the axial direction.

One or more axially intermediate bent portions 9*a* may be formed at the flange portion of the tubular material 9. In the right portion of (b) in FIG. 1, only one axially intermediate bent portion 9*a* is formed at the flange portion of the tubular material 9. The axially intermediate bent portion 9*a* may be formed by bending (e.g., curving) one or more axially intermediate portions of the flange portion of the tubular material 9 by an angle smaller than 90 degrees as illustrated in the right portion of (b) in FIG. 1. The axially intermediate bent portion 9*a* may be formed in the flange portion forming step and/or at the squeezing step of the ironing step. The axially intermediate bent portion 9*a* may be formed at the flange portion forming step only, or may be formed at the squeezing step of the ironing step only, or may be formed at both of the flange portion forming step and the squeezing step of the ironing step. When the axially intermediate bent portion 9*a* is formed at the squeezing step of the ironing step, the axially intermediate bent portion 9*a* is formed by deforming the flange portion of the tubular material 9 by a force squeezing the flange portion of the tubular material 9 between the pressing member 23 and the die 22. Though a bending direction of the axially intermediate bent portion 9*a* and a bending direction of the bent portion 8 may be opposite to each other in the drawing, the axially intermediate bent portion 9*a* and the bent portion 8 may be bent in the same direction. Where a bending angle at the bent portion 8 is large or a force required for ironing is small, the axially intermediate bent portion 9*a* may not be provided.

Each of bending angles of the bent portion 8 and the axially intermediate bent portion 9*a* may be equal to or larger than 90 degrees. However, in a case where an end portion of the tubular member 10A is required to be re-formed as in the case where the tubular member 10A having a non-constant thickness is formed to a wheel rim configuration at a roll-forming step after the ironing step, the re-forming may be difficult, or it may be necessary to remove the flange portion of the tubular material 9 from the tubular member 10A. By forming the axially intermediate bent portion 9*a*, even if the bending angles of the axially intermediate bent portion 9*a* and the bent portion 8 are relatively small (e.g., smaller than 90 degrees), the tubular material 4 is prevented from being drawing by the punch 26 during the ironing step and the roll-forming is easy.

In the ironing step, the tubular material 4 having a constant thickness (having the bent portion 8 and the flange portion of the tubular material 9) is set in the die 22 such that the tubular material 4 axially engages the die 22 by the flange portion of the tubular material 9. Then, the ironing apparatus 20 is operated whereby the pressing member 23 and the punch 26 are moved relative to the die 22 (to approach the die) only in the axial direction of the tubular material 4. When the pressing member 23 and the punch 26 are moved relative to the die 22, the pressing member 23 first contacts the flange portion of the tubular material 9 set in the die 22, thereby squeezing the flange portion of the tubular material 9 between the pressing member 23 and the die 22 (i.e., pressing the flange portion of the tubular material 9 to the die 22 by the pressing member 23), and the pressing member 23 stops. The punch 26 further moves relative to the die 22 (approaches the die) only in the axial direction of the tubular material 4, thereby ironing the portion of the tubular material 4 except the flange portion of the tubular material 9 by the convex and concave surface 24 of the die 22 and the punch 26, accompanied by a change in the diameter and the thickness of the tubular material 4.

Ironing increases the hardness of tubular material 4 due to work hardening and improvements in resistance and fatigue strength are obtained. Where the tubular material 4 is made from steel, the ironing rate (i.e., (a thickness before ironing−a thickness after ironing)/a thickness before ironing×100) may be equal to or smaller than 60%. If the ironing rate is larger than 60%, galling or cracking may be caused in the tubular member 10A. However, ironing at an ironing rate larger than 60% may be conducted.

While the tubular material 4 is ironed, the tubular material 4 is gradually lengthened (extended) in a moving direction of the punch 26.

Where a force required for the ironing is small, the pressing member 23 may be removed.

A lubrication treatment (e.g., phosphate coating, a lubricating oil coating, etc.) may be applied to the tubular material 4 before ironing or during ironing. This may suppress seizure and scratching. However, ironing may be conducted without the lubrication treatment.

Figure 5:
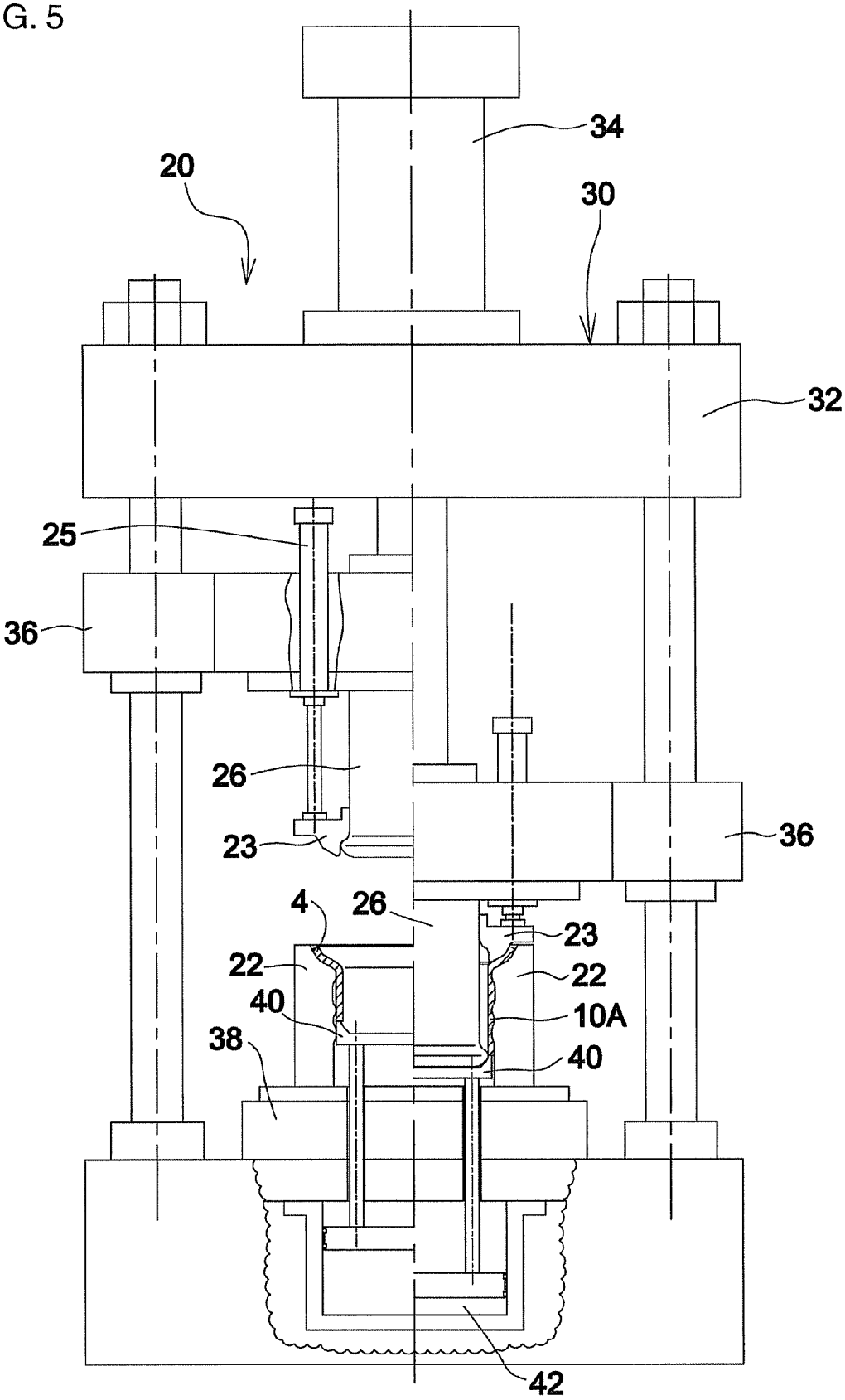
FIG. 5 illustrates an ironing apparatus, a part of which is shown in cross section, used in the method of manufacturing a wheel rim for a vehicle according to the first embodiment of the present invention, a left half of FIG. 5 illustrating a state before ironing where the tubular material is inserted into the die and a right half of FIG. 5 illustrating a state after ironing.

The ironing apparatus 20 may be installed in a stamping machine 30 as shown in FIG. 5. The stamping machine 30 may include a frame 32, a ram driving apparatus 34 coupled to the frame 32, a ram 36 moved in a vertical direction by the ram drive apparatus 34, a bolster 38, an ejecting plate 40, and a plate drive apparatus 42 connected to the ejecting plate 40 and providing a material ejecting force to the ejecting plate 40. The die 22 may be fixed to the bolster 38 or a member fixed to the bolster 38, and the punch 26 may be fixed to the ram 36 or a member fixed to the ram 36. When the ram drive apparatus 34 is operated (i.e., the stamping machine 30 is operated) to lower the ram 36, the punch 26 moves relative to (approaches) the die 22, only in the axial direction of the tubular material 4.

The ram drive apparatus 34 of the stamping machine 30 can be a hydraulic press apparatus using a hydraulic cylinder, a mechanical press apparatus using a motor and a crank shaft, or a servo drive press apparatus using a servo motor and a ball screw. The plate drive apparatus 42 can be a hydraulic cylinder, an air cylinder, or an elevator mechanism using an electric motor.

The die 22 may be fixed and the punch 26 may be movable. As illustrated in (c) of FIG. 1, a side surface of the die 22 opposing a protrusion 28 of the punch 26 may be constructed of the convex and concave surface 24. The convex and concave surface 24 may be a surface whose space from the protrusion 28 of the punch 26 (i.e., a space in a thickness direction of the tubular material 4 having a constant thickness) is not constant. In order to make the space between the protrusion 28 and the side surface of the die 22 opposing the protrusion 28 narrower than the thickness of the tubular material 4 having a constant thickness, the convex and concave surface 24 of the die 22 may be formed:

(a) by providing at least one convex portion 24*a* convex toward the protrusion 28 of the punch 26 relative to a portion (i.e., a concave portion 24*b*) located adjacent to the convex portion 24*a* along the side surface of the die 22 in an axial direction of the die as illustrated in FIGS. 6-9;

(b) by providing at least one convex portion 24*a* convex toward the protrusion 28 of the punch 26 relative to a portion (i.e., a concave portion 24*b*) located adjacent to the convex portion 24*a* along the side surface of the die 22 in a circumferential direction of the die as illustrated in FIGS. 10 and 12; or (c) by a combination of items (a) and (b) above.

A protruding amount of the convex portion 24*a* may be determined by an objective thickness of a corresponding portion of the wheel rim 10B for a vehicle (tubular member 10A) and may be constant or non-constant over each convex portion 24*a*. Further, in a case where a plurality of convex portions 24*a* are provided, protruding amounts of the respective convex portions 24*a* may be determined by objective thicknesses of corresponding portions of the wheel rim 10B for a vehicle (tubular member 10A), and the protruding amounts of the respective convex portions 24*a* may be equal or not equal to each other. The convex portion 24*a* may be provided at a portion or all portions of the side surface of the die 22 opposing the protrusion 28 of the punch 26.

Figure 6:
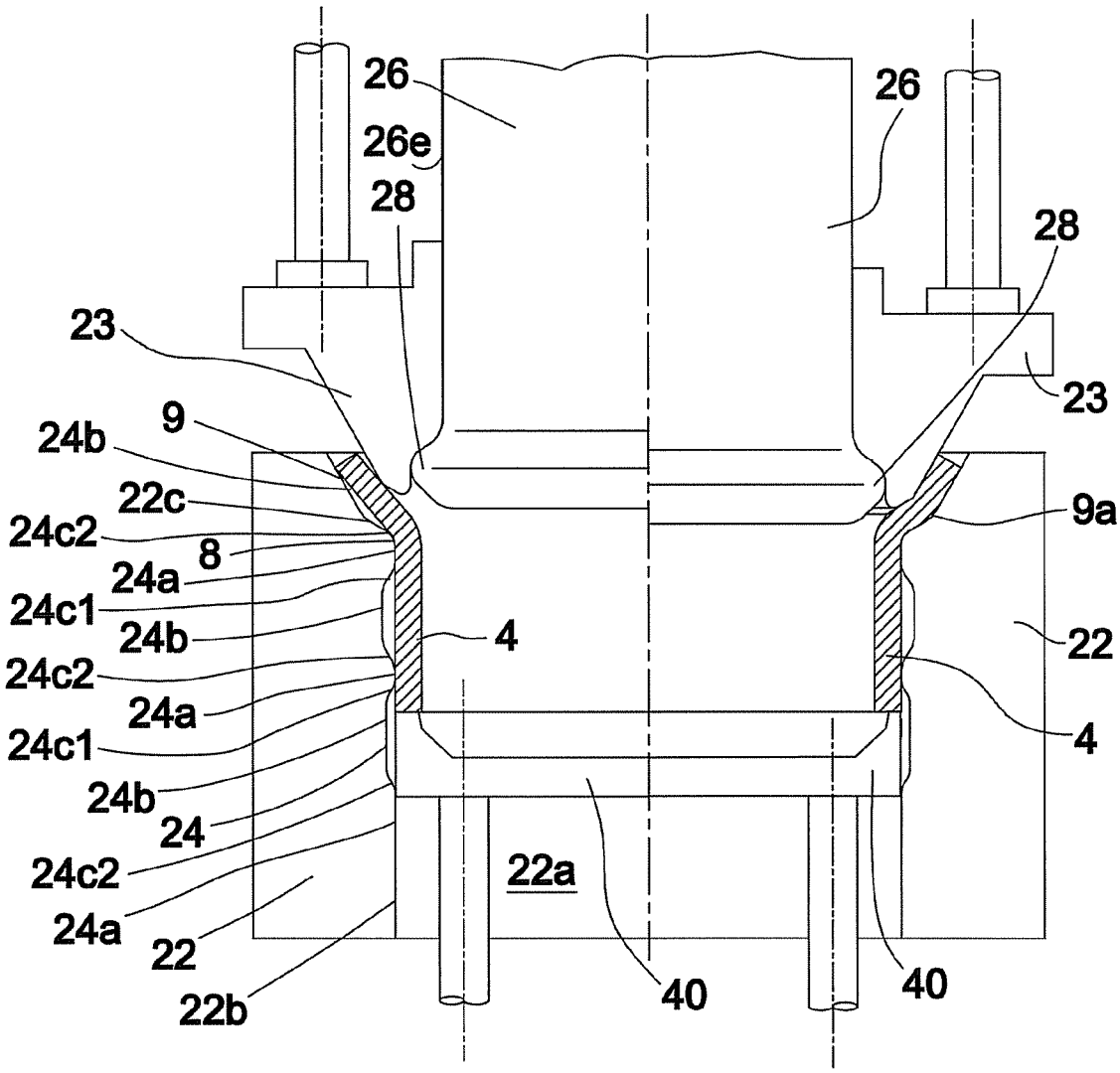
FIG. 6 is an enlarged view of only a tubular material and its vicinity, a part of which is shown in cross section, in the method of manufacturing a wheel rim for a vehicle according to the first embodiment of the present invention in a case where an axially intermediate bent portion is formed at the flange portion of the tubular material at a squeezing step of the ironing step, a left half of FIG. 6 illustrating a state before the axially intermediate portion is formed and a right half of FIG. 6 illustrating a state after the axially intermediate portion is formed.

As illustrated in FIG. 6, in the axial direction of the die 22 along the side surface of the die, one convex portion 24*a* and a concave portion 24*b*, which is located ahead of the punch 26 in a moving direction of the punch 26 during ironing and is adjacent to the one convex portion 24*a*, may be connected via a first inclined surface 24*c*1 which is not perpendicular to the axis of the die 22. The reason why the inclined surface 24*c*1 is provided is that, compared with a surface perpendicular to the axis of the die, the tubular member 10A is not liable to interfere with the convex portion 24*a* and can be more smoothly taken out from the die 22 when an ejecting force is loaded on the tubular member 10A from the ejecting plate 40.

Further, in the axial direction of the die 22 along the side surface of the die, one convex portion 24*a* and a concave portion 24*b*, which is located ahead of the ejecting plate 40 in a moving direction of the ejecting plate 40 during ejecting the tubular member 10A from the die 22 and is adjacent to the one convex portion 24*a*, may be connected via a second inclined surface 24*c*2 which is not perpendicular to the axis of the die 22. The reason why the inclined surface 24*c*2 is provided is that, compared with a surface perpendicular to the axis of the die, a plastic flow of material due to ironing during the ironing may be easier.

Angles of the first inclined surface 24*c*1 and the second inclined surface 24*c*2 inclined from the axial direction of the die 22 along the side surface of the die 22 may be set at an angle equal to or smaller than 60 degrees, or equal to or smaller than 45 degrees, or equal to or smaller than 20 degrees, and or equal to or smaller than 10 degrees. The reason why the angle may be equal to or smaller than 10 degrees is that generation a scratches in the tubular member 10A due to ironing can be suppressed. An inclination angle relative to the axial direction of the side surface of the die 22, of a second inclined surface 24*c*2 located closest to the flange portion of the tubular material 9 may be larger than 60 degrees. An inclination angle of each first inclined surface 24*c*1 may be constant, or may change gradually. An inclination angle of each second inclined surface 24*c*2 may be constant, or may change gradually.

The punch 26 may have the protrusion 28 protruding toward the die 22 at a fore end portion of the punch moved toward the die 22 and irons the tubular material 4 by the protrusion 28. The flange portion of the tubular material 9 except in the vicinity of the bent portion 8 is not contacted by the punch 26 and is not ironed.

Figure 7:
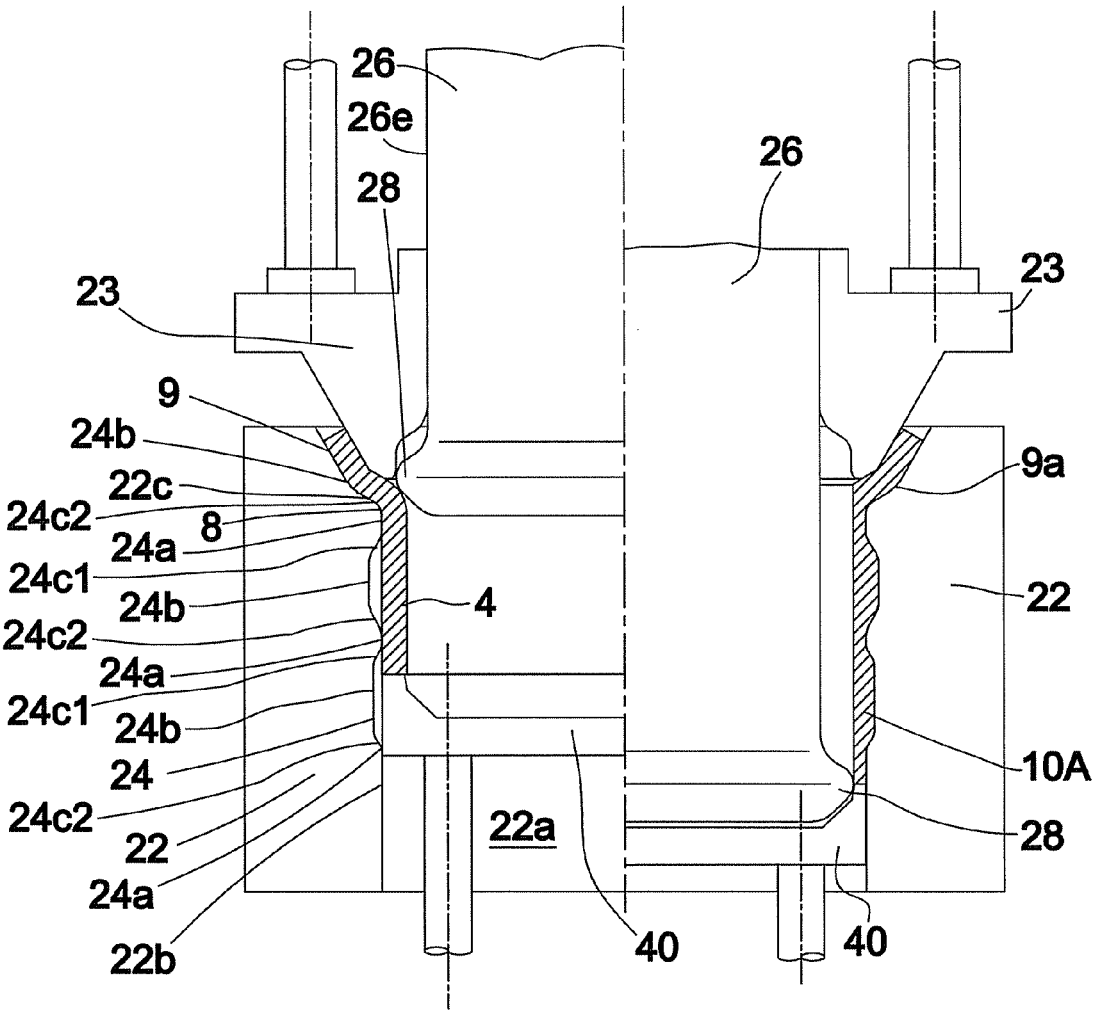
FIG. 7 is an enlarged view of only a tubular material and its vicinity, a part of which is shown in cross section, in the method of manufacturing a wheel rim for a vehicle according to the first embodiment of the present invention, a left half of FIG. 7 illustrating a state before ironing and a right half of FIG. 7 illustrating a state after ironing.
Figure 8:
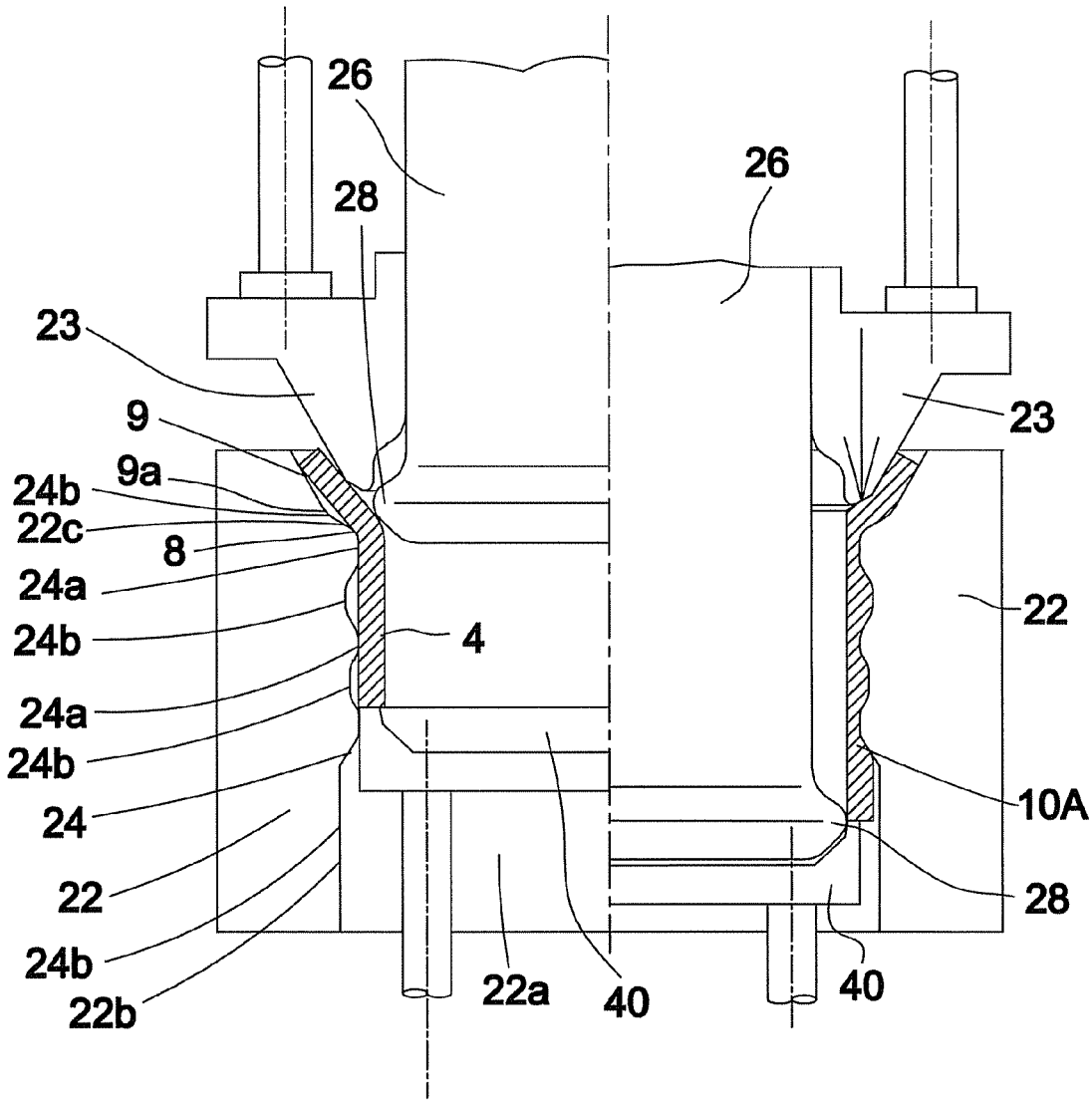
FIG. 8 is an enlarged view of only a tubular material and its vicinity, a part of which is shown in cross section, in the method of manufacturing a wheel rim for a vehicle according to the first embodiment of the present invention, in a case where an end portion of the tubular material opposite the flange portion of the tubular material is not thinned by ironing, because a protrusion is not provided at a portion of a die corresponding to the end portion of the tubular material opposite the flange portion of the tubular material, a left half of FIG. 8 illustrating a state before ironing and a right half of FIG. 8 illustrating a state after ironing.

An end portion of the tubular material 4 opposite the flange portion of the tubular material 9 may be thinned or may not be thinned corresponding to whether or not the protrusion 24*a* of the die 22 is provided. More particularly, when the protrusion 24*a* is provided at a portion of the die 22 corresponding to the end portion of the tubular material 4 opposite the flange portion of the tubular material 9, as illustrated in FIG. 7, the end portion of the tubular material 4 opposite the flange portion of the tubular material 9 may be thinned due to ironing. When the protrusion 24*a* is not provided at a portion of the die 22 corresponding to the end portion of the tubular material 4 opposite the flange portion of the tubular material 9, as illustrated in FIG. 8, the end portion of the tubular material 4 opposite the flange portion of the tubular material 9 may not be thinned due to ironing.

By stopping movement of the punch 26 relative to the die 22 when the protrusion 28 reaches an axially intermediate portion of the tubular material 4 and then drawing out the punch 26 from the die 22, as illustrated in FIG. 9, the end portion of the tubular material 4 located ahead of the stopping position of the punch 26 (i.e., the end portion of the tubular material opposite the flange portion of the tubular material 9) can maintain a thickness of the material without being ironed.

The ejecting plate 40 receives (supports) the tubular material 4 (in the axial direction of the tubular material 4) from a direction opposite to the direction in which the punch 26 moves during ironing (i.e., the direction in which the punch 26 pushes the tubular material 4), in order that the axial end portion of the tubular material 4 opposite the flange portion of the tubular material 9 extends axially more than an expected extending amount during ironing and is offset from an expected position relative to the die 22. Though the axial length of the tubular material 4 is gradually lengthened when the tubular material 4 is ironed, a position of the ejecting plate 40 is controlled by the plate drive apparatus 42 and the ejecting plate 40 recedes according to a change in the axial length of the tubular material 4, so that the ejecting plate 40 can push the tubular material 4 in the axial direction at a constant force, or at a substantially constant force, during ironing.

The load on the ejecting plate 40 may be controlled, or the amount of displacement of the ejecting plate 40 may be controlled.

By fixing the ejecting plate 40 at a predetermined position and receiving the tubular material 4 by the ejecting plate 40, it is possible to restrict a change in the axial length of the tubular material 4 and to keep the axial length of the tubular material.

As illustrated in (c) of FIG. 1, in the ironing step, after the punch 26 is lowered and the tubular member 10A is manufactured, the punch 26 is extracted from the die 22. After the punch 26 is extracted from the die 22, or when the punch 26 is being extracted from the die 22, an axial force from the ejecting plate 40 is loaded on the tubular member 10A thereby deforming the tubular member 10A in a radial direction of the tubular member and removing the tubular member 10A from the die 22. When a rate of change in the diameter of the tubular member 10A necessary to remove the tubular member 10A from the die 22 is small, the tubular member 10A can be removed from the die 22 by elastically deforming the tubular member 10A in a radial direction of the tubular member 10A (i.e., in a thickness direction of the tubular member 10A) by the axial force from the ejecting plate 40. Contrarily, when a rate of change in the diameter of the tubular member 10A necessary to remove the tubular member 10A from the die 22 is large, the tubular member 10A can be removed from the die 22 by plastically deforming the tubular member 10A in a radial direction of the tubular member 10A by the axial force from the ejecting plate 40. By designing the punch and die based on an expected rate of change in the diameter of the tubular member 10A necessary to remove the tubular member 10A from the die 22, a tubular member 10A having a high dimensional accuracy can be manufactured.

The ejecting plate 40 pushes the tubular member 10A in the direction opposite the direction in which the punch 26 moves (i.e., the direction in which the punch 26 pushes the tubular material 4) during ironing. The axial force which the ejecting plate 40 imposes on the tubular member 10A when removing the tubular member 10A may be equal to or larger than a force necessary to deform the tubular member 10A in the radial direction of the tubular member, thereby removing the tubular member 10A when the ejecting plate 40 axially pushes the tubular member 10A. The force is much smaller than the ironing force with which the punch 26 axially pushes the tubular material 4. Since the die 22 is not required to be divided in the circumferential direction of the die to remove the tubular member 10A, the die 22 may not be divided and may be constructed as an integral die.

The tubular member 10 having a non-constant thickness may include a thick portion (a portion where the thickness is not thinned) and a thin portion (a portion where the thickness is thinned). The thick portion (a portion not thinned in thickness) of the tubular member 10 may correspond to a portion where a large force is imposed (e.g., in the case of a wheel rim, a curved portion and a flange portion of the rim) during use of the final product. The thin portion (a portion thinned in thickness) may correspond to a portion where a small force is imposed (in the case of the wheel rim, a portion other than the curved portion and the flange portion of the rim) during use of the final product. Owing to the structures, lightening, material savings and cost reduction are obtained while maintaining a necessary strength and rigidity in the final product.

As illustrated in FIG. 3, the method of manufacturing a wheel rim for a vehicle 10B according to the present invention may include a step of roll-forming the tubular member 10A having a non-constant thickness to form a vehicle wheel rim configuration, after the ironing step.

As illustrated in (a) and (b) of FIG. 3, the roll-forming step is conducted after at least either one of axially opposite ends of the tubular member 10A having a non-constant thickness is flared. Where flaring is performed during the roll-forming, the flaring may be omitted.

As illustrated in (c), (d) and (e) of FIG. 3, in the roll-forming, a wall of the tubular member 10A is squeezed between a lower roll 31 and an upper roll 32, and then the rolls are rotated, thereby forming the tubular member 10A into a wheel rim having a rim configuration. Then, the wheel rim is sized (formed to a true circle and a cross section of a wheel rim for a vehicle) to a final rim configuration using an expander and/or a shrinker as illustrated in (f) of FIG. 3. A portion or an entire portion of the flange portion of the tubular material 9 may be changed to a flange portion 10*a* (or 10*g*) of a flange portion of the rim 10*a* of the wheel rim 10B for a vehicle.

The wheel rim 10B for a vehicle after forming may include a flange portion of the rim 10*a*, a bead seat portion 10*b*, a side wall portion 10*c*, a drop portion 10*d*, a side wall portion 10*e*, a bead seat portion 10*f* and a flange portion of the rim 10*g*, in that order from one axial end to the other axial end of the rim. A wheel disk (not shown) may be fit into the rim 10B for a vehicle and then welded to the rim, whereby a wheel of a weld type is manufactured. Curved portions may exist between the above-listed portions of the rim. Larger stresses may be generated at the curved portions and the flange portions of the rim 10*a* and 10*g* than stresses generated at other portions. Preferably, the thicknesses of the curved portions and the flange portions of the rim 10*a* and 10*g* are larger than thicknesses of other portions. The roll-formed wheel rim 10B for a vehicle may be such a wheel rim as illustrated in FIG. 4, where one of the flange portions of the rim 10*a* or 10*g* of the rim (in the example shown, the flange portion of the rim 10*a*) does not exist, and the removed rim flange portion of the rim 10*a* is provided on a wheel disk (not shown) to be combined with the rim.

When a tubular material 4 having a constant thickness is formed into a wheel rim, conventionally, the constant thickness of the tubular material has not been formed to a non-constant thickness by ironing. Conventionally, the tubular material having a constant thickness is conveyed, as it is, to a rim configuration forming step that uses roll-forming. Even if the tubular material having a constant thickness is formed to a tubular material having a non-constant thickness, conventionally, any method other than spinning has not been considered for use as explained in the background, and in fact, has not been used. In the present invention, the ironing step is inserted between the step of manufacturing the tubular material 4 and the step for roll-forming the tubular member 10A, thereby making the tubular material 4 non-constant in thickness without using spinning.

Operations and technical advantages of portions common to all embodiments of the present invention will now be explained.

In the present invention, since the tubular material 4 having a constant thickness is formed into the tubular member 10A having a non-constant thickness by ironing, the equipment and the step of conventional flow-forming may not be required to be provided. As a result, the afore-mentioned problems (i), (ii) and (iii) accompanied by the flow-forming may be solved as the following ways (i), (ii) and (iii), respectively:

(i) Since the conventional flow-forming equipment may be replaced by the die 22 and punch 26 for ironing and the ironing apparatus 20 (the stamping machine 30) in the present invention and the combined cost of the die 22 and punch 26 for ironing and the ironing apparatus 20 (the stamping machine 30) may be lower than that of the flow-forming equipment, the equipment cost may be decreased.

(ii) Since in the step of making the thickness of the tubular material 4 non-constant, the conventional flow-forming step may be replaced by the ironing step using the ironing apparatus 20 (the stamping machine 30) in the present invention, a time period for making the thickness of the tubular material 4 non-constant may be decreased to about one third of the time period required in the flow-forming, and the productivity may be improved. When a step of making a thickness of a cylindrical hollow material non-constant is provided to one rim manufacturing line, three sets of flow-forming equipment may be required to be provided in the conventional rim manufacturing line. However, since the three sets of the flow-forming equipment may be replaced by a single ironing apparatus 20 (the stamping machine 30) according to the present invention, the problems relating to a cost and a space required for placing the equipment existing in the flow-forming may be solved.)

(iii) Since the flow-forming is replaced by the ironing using the punch 26 and die 22, any pushing flaw due to the flow-forming roll may not remain at a surface of the material, and an appearance quality may be improved.

Since the punch 26 may be moved relative to the die 22 and the tubular material 4 may be ironed to form the tubular member 10A having a non-constant thickness, a movement of the punch 26 relative to the die 22 may be an axial movement only, accompanied by no radial movement, so that a stamping machine 30 may be used for the uni-directional movement of the punch 26 relative to the die 22. As a result, the time period of forming may be reduced and the equipment cost may be decreased.

Since after manufacturing the tubular member 10A having a non-constant thickness, the tubular member 10A may be taken out from the die 22 by adding an axial force to the tubular member 10A so that the tubular member 10A is deformed in the radial direction of the tubular member 10A, an integral die which is not divided in a circumferential direction may be used for the die 22. As a result, the equipment cost may be maintained low as compared with a case where a circumferentially divided die is used, because a mechanism for moving divided die elements in a radial direction is unnecessary to be provided. Further, no burr will be generated at a portion of the ironed tubular member corresponding to a butting portion of the circumferentially divided die elements, and no work for removing burrs will be necessary.

Since in the ironing step the flange portion of the tubular material 9 is caused to axially engage the die 22 and then the ironing is conducted, the tubular material 4 may be prevented from being moved as a whole in the direction in which the punch 26 pushes the tubular material 4 so that forming with a high accuracy may be possible.

Since the flange portion of the tubular material 9 is squeezed between the die 22 and the pressing member 23 during ironing and then at least a portion of the tubular material 4 other than the flange portion of the tubular material 9 is ironed, the tubular material 4 may be prevented from being moved as a whole in the axial direction in which the punch 26 pushes the tubular material 4, so that forming with a high accuracy may be possible.

The flange portion of the tubular material 9 is not thinned due to ironing, because the flange portion of the tubular material 9 except a vicinity of the bent portion 8 is not ironed. Since the flange portion of the tubular material 9 comes to the flange portion of the rim 10*a* (or 10*g*) after roll-forming, the flange portion of the tubular material may be maintained relatively thick when formed to a wheel rim 10B for a vehicle. As a result, durability of the wheel rim for a vehicle may be improved.

Since one or more axially intermediate bent portions 9*a* may be formed in the flange portion of the tubular material 9 at the flange portion forming step before the ironing step and/or at the squeezing step of the ironing step by bending one or more portions of an axially intermediate portion of the flange portion of the tubular material 9, the tubular material 4 may resist being drawn into the die by the punch 26 and moved relative to the die 22 than a case where the axially intermediate bent portions 9*a* are not formed at the flange portion of the tubular material 9.

Since a bending direction of at least one of the axially intermediate bent portions 9*a* and a bending direction of the bent portion 8 may be opposite to each other, a portion of the flange portion of the tubular material 9 between the axially intermediate bent portion 9*a* whose bending direction is opposite to the bending direction of the bent portion 8 and the axial end of the tubular member engages with the pressing member 23 whereby the tubular material 4 may resist being drawn into the die by the punch 26 and moved relative to the die 22 during ironing, differently from a case where a bending direction of each of the one or more axially intermediate bent portions 9*a* and a bending direction of the bent portion 8 are the same.

When the axially intermediate bent portion 9*a* may be formed at the flange portion forming step only, compared with a case where the axially intermediate bent portion 9*a* is formed at the squeezing step of the ironing step, the tubular material 4 may resist being dislocated relative to the die 22 when the flange portion of the tubular material 9 is squeezed between the pressing member 23 and the die 22.

When the axially intermediate bent portion 9*a* is formed at the squeezing step of the ironing step only, it may not be necessary to form the axially intermediate bent portion 9*a* at the tubular material manufacturing step and therefore, it may be easy to form the bent portion 8 and the flange portion of the tubular material 9 (it may be possible to simplify the flange portion forming step).

Since the tubular material 4 may be supported at the end portion by the ejecting plate 40 and is ironed, the tubular material 4 may further resist being moved as a whole in the axial direction in which the punch 26 pushes the tubular material 4. Further, control of the extension amount of the tubular material 4 during ironing may be easy.

Since the convex and concave surface 24 is formed by providing at least one convex portion 24*a* making a space between the die 22 and the punch 26 narrower than a thickness of the tubular material 4 having a constant thickness at the die 22, in an axial direction of the die 22 along the side surface of the die 22, a tubular member 10A having a thickness that changes in the axial direction may be manufactured.

Since the convex and concave surface 24 is formed by providing at least one convex portion 24*a* making a space between the die 22 and the punch 26 narrower than a thickness of the tubular material 4 having a constant thickness at the die 22, in a circumferential direction of the die 22 along the side surface of the die 22, a tubular member 10*a* having a thickness that changes in the circumferential direction may be manufactured.

Since the method of manufacturing the tubular member has the step of roll-forming the tubular member 10A having a non-constant thickness to a wheel rim having a rim configuration, it is possible to manufacture a wheel rim 10B having a non-constant thickness, and that may be light and improved in durability, by forming at least one portion of the flange portion of the rim 10*a* (or 10*g*) which needs greater thickness, from the flange portion of the tubular material 9.

Next, structures unique to each embodiment of the present invention will be explained.

[First Embodiment]

In the method of manufacturing the wheel rim 10B for a vehicle according to the first embodiment of the present invention, as illustrated in (c) of FIG. 1 and FIG. 6, the die 22 may be constructed of an outer die having a cylindrical bore 22*a* and an inner side surface 22*b*. The inner side surface 22*b* of the outer die may form the convex and concave surface 24. The punch 26 may be constructed of an inner punch which moves into or out from the cylindrical bore 22*a* of the outer die 22 in the axial direction of the cylindrical bore. The protrusion 28 may be formed at an outside surface 26*e* of the inner punch. The flange portion of the tubular material 9 may be bent outwardly in the radial direction of the tubular material 4.

As illustrated in FIG. 6, a flange receiving portion 22*c*, with which the flange portion of the tubular material 9 engages, may be formed at an upper end portion of the inner side surface 22*b* of the outer die 22. The tubular material 4 may be set to the outer die 22 by causing the flange portion of the tubular material 9 to contact and engage the flange receiving portion 22*c*.

An inner diameter of a portion of the outer die 22 where the convex portion 24*a* is provided may be larger than an outer diameter of a portion of the tubular material 4 other than the flange portion of the tubular material 9 before ironing. Therefore, the tubular material 4 before ironing can be easily set to the outer die 22.

An outer diameter of the protrusion 28 of the inner punch 26 may be larger than an inner diameter of the tubular material 4 other than the flange portion of the tubular material 9 before ironing. Therefore, a convex and concave configuration of the convex and concave surface 24 of the die 22 can be transferred to the tubular material 4 by pushing the tubular material 4 to the die 22 by ironing.

A difference between an outer radius of the protrusion 28 of the inner punch 26 and an inner radius of the portion of the outer die 22 where the convex portion 24*a* is provided may be smaller than the thickness of the tubular material 4 before ironing. Therefore, the thickness of the tubular material 4 can be thinned by ironing at the convex portion 24*a*.

When the punch 26 is moved by the ironing apparatus 20 (e.g., the stamping machine 30) into the cylindrical bore 22*a* of the outer die 22 set with the tubular material 4, the protrusion 28 of the punch 26 irons the tubular material 4 thereby enlarging the diameter of the tubular material 4, and the portion of the outer die 22 where the convex portion 24*a* is provided reduces the thickness of the tubular material 4.

When a difference between the inner radius of a portion of the outer die 22 where the convex portion 24*a* is not provided and the outer radius of the protrusion 28 of the inner punch 26 is equal to or larger than the thickness of the tubular material 4 before ironing, the thickness of the tubular material 4 is not thinned due to ironing more than a reduction in thickness of the tubular material generated when the inner radius of the tubular material 4 is enlarged by the protrusion 28 of the punch 26. The thickness of the tubular material 4 can be thickened relative to an initial thickness of the tubular material 4, and by controlling the ejecting plate 40 for receiving the tubular material 4, the thickness of the tubular material 4 can be further thickened.

When the tubular material 4 is ironed, the tubular material 4 is liable to move as a whole in the axial direction in which the inner punch 26 pushes the tubular material 4. The axial movement of the tubular material 4 may be suppressed because the flange portion of the tubular material 9 engages the flange receiving portion 22*c* of the outer die 22, because the flange portion of the tubular material 9 is squeezed between the pressing member 23 and the die 22, and because the ejecting plate 40 receives the tubular material 4 in a direction opposite the direction in which the inner punch 26 pushes the tubular material 4. As a result, the axial positions of a thick portion and a thin portion formed in the tubular member 10 may be prevented from being dislocated from the axial positions of the convex and concave surface 24 of the outer die 22. In a wheel rim 10B manufactured by roll-forming the tubular member 10A, a portion where a relatively large thickness is required may be thick, and a portion where a relatively large thickness is not required may be thin, so that the wheel rim 10B may be light.

In the method of manufacturing the wheel rim 10B for a vehicle according to the first embodiment of the present invention, the die 22 may be constructed of the outer die having the cylindrical bore 22*a* and the inner side surface 22*b* which is the convex and concave surface 24, and the punch 26 may be constructed of the inner punch which moves into and out from the cylindrical bore 22*a* of the outer die 22. The outer die 22 may be fixed to the bolster 38 located at a lower portion of the ironing apparatus 20 (the stamping machine 30), and the inner punch 26 may be fixed to the ram 36 located at an upper portion of the ironing apparatus 20 (the stamping machine 30). The inner punch 26 is moved up and down in the vertical direction relative to the outer die 22. By this structure, the ironing apparatus 20 (the stamping machine 30) can be used for manufacturing of the tubular member 10A.

Further, since the flange portion of the tubular material 9 may be bent outwardly in the radial direction of the tubular material 4, it may be easy to form the ironed tubular member 10A to the wheel rim 10B for a vehicle by flaring and roll-forming.

[Second Embodiment]

In the method of manufacturing the tubular member 10 according to the second embodiment of the present invention, as illustrated in FIGS. 11 and 12, the die 22 may be constructed of an inner die having an outer side surface 22*e*. The outer side surface 22*e* of the inner die 22 may be constructed to be the convex and concave surface 24. The punch 26 may be constructed of an outer punch having an cylindrical bore 26*a* and an inner side surface 26*b*. The protrusion 28 may be formed at the inner side surface 26*b* of the outer punch.

A flange receiving portion 22*d*, with which the flange portion of the tubular material 9 engages, may be formed at an upper end portion of the outer side surface 22*e* of the inner die 22. The tubular material 4 may be set to the inner die 22 by causing the flange portion of the tubular material 9 to contact and engage the flange receiving portion 22*d*.

An outer diameter of a portion of the inner die 22 where the convex portion 24*a* is provided may be smaller than an inner diameter of a portion of the tubular material other than the flange portion of the tubular material 9 before ironing. Therefore, the tubular material 4 before ironing can be easily set to the inner die 22.

An inner diameter of the protrusion 28 of the outer punch 26 may be smaller than an outer diameter of the tubular material other than the flange portion of the tubular material 9 before ironing. Therefore, an convex and concave configuration can be formed to the tubular material 4 by pushing the tubular material 4 to the die 22 during ironing.

A difference between an inner radius of the protrusion 28 of the outer punch 26 and an outer radius of the portion of the inner die 22 where the convex portion 24*a* is provided may be smaller than the thickness of the tubular material 4 before ironing. Therefore, the thickness of the tubular material 4 can be thinned at the convex portion 24*a* by ironing.

When the outer punch 26 is moved by the ironing apparatus 20 (e.g., the press machine 30) toward the inner die 22 at which the tubular material 4 is set and the inner die 22 enters the cylindrical bore 26*a* of the outer punch 26, the protrusion 28 of the outer punch 26 irons the tubular material 4 thereby shrinking the diameter of the tubular material 4, and the portion of the inner die 22 where the convex portion 24*a* is provided thins the thickness of the tubular material 4.

When a difference between the outer radius of the portion of the inner die 22 where the convex portion 24*a* is not provided and the inner radius of the protrusion 28 of the outer punch 26 is equal to or larger than the thickness of the tubular material 4 before ironing, the thickness of the tubular material 4 is not thinned during ironing. The thickness of the tubular material 4 may even be increased relative to an initial thickness of the tubular material 4.

When the tubular material 4 is ironed, the tubular material 4 is liable to move as a whole in the axial direction in which the outer punch 26 pushes the tubular material 4. However, the axial movement of the tubular material 4 may be suppressed because the flange portion of the tubular material 9 engages the flange receiving portion 22*d* of the inner die 22, because the flange portion of the tubular material 9 is squeezed between the pressing member 23 and the die 22, and because the ejecting plate 40 receives the tubular material 4 in a direction opposite the direction where the outer punch 26 pushes the tubular material 4. As a result, the axial positions of a thick portion and a thin portion formed in the tubular member 10 may be prevented from being dislocated relative to the axial positions of the convex and concave surface 24 of the inner die 22. In a wheel rim 10B for a vehicle manufactured by roll-forming the tubular member 10A, a portion where a relatively large thickness is required may be thick, and a portion where a relatively large thickness is not required may be thin, so that the wheel rim 10B may be light.

In the method of manufacturing the wheel rim 10B for a vehicle according to the second embodiment of the present invention, the die 22 may be constructed of the inner die having the outer side surface which is the convex and concave surface 24, and the punch 26 may be constructed of the outer punch having the cylindrical bore 26*a* and the inner side surface. The inner die 22 may be fixed to the lower bolster 38 of the ironing apparatus 20 (the stamping machine 30), and the outer punch 26 may be fixed to the upper ram 36 of the ironing apparatus 20 (the stamping machine 30). The outer punch 26 may be stroked in the vertical direction relative to the inner die 22. By this structure, the ironing apparatus 20 (the stamping machine 30) can be used for manufacturing of the tubular member 10A.

The invention claimed is:

1. A method of manufacturing a wheel rim for a vehicle comprising:

forming a flange portion by bending an axial end portion of a tubular material made from steel in a direction crossing an axial direction of the tubular material, thereby forming in the tubular material a bent portion and the flange portion on a tip side of the bent portion, ironing the tubular material to a tubular member having a non-constant thickness using an ironing apparatus which has a punch, a die having a convex and concave surface opposing the punch and a pressing member, and roll-forming the tubular member having a non-constant thickness to a vehicle wheel rim configuration after the ironing, wherein the ironing comprises:

setting the tubular material on the die at the flange portion of the tubular material;

then moving the pressing member relative to the die thereby squeezing the flange portion of the tubular material between the pressing member and the die; and then, while the flange portion of the tubular material is squeezed between the pressing member and the die, moving the punch relative to the die thereby ironing at least a portion of the tubular material except the flange portion of the tubular material to manufacture the tubular member having a non-constant thickness, wherein at the roil-forming, at least a portion of the flange portion of the tubular material is formed to one of the flange portions of the rim of the wheel rim for a vehicle, and wherein the steps of forming the flange portion, ironing the tubular material, and roll-forming the tubular member are conducted in the order of forming the flange portion, ironing the tubular material, and roll-forming the tubular member.

2. A method of manufacturing a wheel rim for a vehicle according to claim 1, wherein the flange portion of the tubular material has one or more axially intermediate bent portions.

3. A method of manufacturing a wheel rim for a vehicle according to claim 2, wherein a bending direction of at least one of the one or more axially intermediate bent portions and a bending direction of the bent portion are opposite to each other.

4. A method of manufacturing a wheel rim for a vehicle according to claim 3, wherein the axially intermediate bent portions are formed before the ironing and/or at the squeezing of the ironing.

5. A method of manufacturing a wheel rim for a vehicle according to claim 3, wherein a bending angle of the tubular material at the bent portion is smaller than 90 degrees.

6. A method of manufacturing a wheel rim for a vehicle according to claim 2, wherein the axially intermediate bent portions are formed before the ironing and/or at the squeezing of the ironing.

7. A method of manufacturing a wheel rim for a vehicle according to claim 2, wherein a bending angle of the tubular material at the bent portion is smaller than 90 degrees.

8. A method of manufacturing a wheel rim for a vehicle according to claim 1, wherein at the ironing, the tubular material is received and pushed by an ejecting plate at an end of the tubular material opposite the flange portion of the tubular material.

9. A method of manufacturing a wheel rim for a vehicle according to claim 1, wherein the convex and concave surface is formed by providing at least one convex portion making a space between the die and the punch narrower than a thickness of the tubular material, at the die in an axial direction of the die along the side surface of the die opposing the punch.

10. A method of manufacturing a tubular member according to claim 1, wherein the convex and concave surface is formed by providing at least one convex portion making a space between the die and the punch narrower than a thickness of the tubular material, at the die in a circumferential direction of the die along the side surface of the die opposing the punch.

* * * * *